US005743040A

United States Patent [19]

Kennedy

[11] Patent Number: 5,743,040

[45] Date of Patent: Apr. 28, 1998

[54] METHOD AND APPARATUS FOR CLEANING THE BARREL OF A GUN

[76] Inventor: Steven C. Kennedy, 11498 Broadbent Rd., Lansing, Mich. 48917

[21] Appl. No.: 863,290

[22] Filed: May 27, 1997

[51] Int. Cl.[6] ..... F41A 29/00

[52] U.S. Cl. ..... 42/95

[58] Field of Search ..... 42/95; 15/104.16

[56] References Cited

U.S. PATENT DOCUMENTS

| | | | |
|---|---|---|---|
| 990,977 | 5/1911 | Griffith | 15/104.18 |
| 1,499,460 | 7/1924 | Kennedy | 15/104.05 |
| 2,409,916 | 10/1946 | Varcoe | 15/104.165 |
| 4,045,900 | 9/1977 | Byer . | |
| 4,404,979 | 9/1983 | Hobbs . | |
| 4,599,173 | 7/1986 | Berger . | |
| 4,698,932 | 10/1987 | Schneider | 42/95 |
| 4,766,755 | 8/1988 | Allen . | |
| 4,858,360 | 8/1989 | Hardin . | |
| 4,866,871 | 9/1989 | Rivers | 42/95 |
| 5,095,644 | 3/1992 | McCoy . | |
| 5,202,523 | 4/1993 | Grossman et al. . | |
| 5,628,136 | 5/1997 | Wickser, Jr. | 42/95 |

*Primary Examiner*—Charles T. Jordan
*Assistant Examiner*—Meena Chelliah
*Attorney, Agent, or Firm*—Mary M. Moyne; Ian C. McLeod

[57] ABSTRACT

A method and apparatus (10, 110 or 210) for cleaning the barrel (100) of a gun, is described. The apparatus includes a container (12, 112 or 212) and a cleaning rod (54). The container has end caps (30 and 32) which seal the container and form an inner chamber (12A, 112A or 212A). The top end cap has an opening for insertion of the cleaning rod. The end caps have holders (48) with recesses (48C) which hold the ends of the barrel in the container. The holders preferably have an opening in the bottom wall (48D) of the recess and orifices (52) around the sidewall. To use, the barrel of the gun is mounted in the bottom end cap inside the container and cleaning fluid (102) is poured into the container. The top end cap is sealed onto the container and the cleaning rod is inserted into the container and into the inside of the barrel. As the cleaning rod is moved up and down in the barrel, the cleaning fluid is draining into the orifices and the opening in the bottom end cap and through the barrel and out through the opening and orifices in the top end cap.

20 Claims, 3 Drawing Sheets

METHOD AND APPARATUS FOR CLEANING THE BARREL OF A GUN

BACKGROUND OF THE INVENTION (1) Field of the Invention

The present invention relates to an apparatus for cleaning the barrel of a gun. In particular, the present invention relates to an apparatus having a tubular chamber which holds the cleaning fluid and the barrel and which allows the use of a cleaning rod to move the cleaning fluid through the barrel to clean the inside of the barrel.

(2) Description of the Related Art

The related art has shown various apparatuses for cleaning firearms. Illustrative are U.S. Pat. No. 4,045,900 to Byer; U.S. Pat. No. 4,404,979 to Hobbs and U.S. Pat. No. 5,202,523 to Grossman et al.

In addition, U.S. Pat. No. 5,095,644 to McCoy shows a black powder firearm cleaning kit. The kit includes a cleaning pump for mounting at one end of the barrel. The pump includes a piston which extends out of the cylindrical body of the pump. A cleaning brush rod and brush are mounted at the forward end of the piston. A conduit pipe is connected to the cylindrical body of the pump for directing cleaning fluid into the pump in front of the piston. The piston is used to direct the fluid within the barrel to clean the barrel. A second flexible hose is mounted on the other end of the firearm for directing the fluid through the rifle barrel to a drain connection. In this device, the cleaning fluid passes through the barrel only one time.

Further, U.S. Pat. No. 4,858,360 to Hardin describes a hollow cleaning rod device for the barrel of a black powder firearm.

Also of interest is U.S. Pat. No. 4,766,755 to Allen which describes a plunger-type cleaning device for cleaning paint rollers. The device includes a receptacle having a container and a cap. A piston rod extends through the cap and is connected to a piston within the container. A seating member having fluid conducting apertures is secured to the base of the container and allows for mounting the roller. In one embodiment (FIGS. 1 and 2), the container has an inner cylinder and an outer cylinder. The inner cylinder forms a cylindrical space within which is mounted the paint roller. Once the roller is in the container, the cap is secured on the container such that the plunger rides along the inner wall of the tube of the roller. The plunger is moved upward such as to draw fluid through a valve into the container and into the interior of the roller. The fluid is also drawn up along the nape of the roller and exits into a passageway between the cylinder walls to outlets. The plunger is then moved downward toward the base of the container. The downward movement moves the fluid in the interior of the roller out the apertures in the seat member and up along the nape of the roller and into the passageway which leads to the outlets. In an alternate embodiment shown in FIG. 4, the device is self-contained. The container has conical seats at both ends for holding the roller. The seats have apertures to allow the fluid to pass from the interior of the roller to the nape of the roller. To use the device, the roller is placed in the container. The container is then filled with the cleaning fluid and the cap is placed on the container. The plunger is preferably adjacent the cap when the cap is secured on the container. Once the cap is secured, the plunger is then moved back and forth in a reciprocating manner within the interior of the container. The movement of the plunger causes the fluid to be moved in opposite directions through the interior of the roller and over the nape of the roller. The device is not intended to clean the inside of the roller.

U.S. Pat. No. 4,599,173 to Berger describes a vessel for immersion of cartridge-type filter media in a cleaning fluid. The bottom of the vessel has a raised central hub portion with a downwardly tapered profile which allows for automatic centering of the filter media in the vessel. A draining valve at the bottom of the vessel allows for the entire vessel to be emptied of cleaning fluid and also allows for removal of only the cleaning fluid at the bottom of the vessel which has a high concentration of settleable materials. The draining valve may also be connected to a source of compressed air which is used to impart agitation to the cleaning fluid for more efficient cleaning. A tapping valve at the top of the vessel is used to remove cleaning fluid near the top of the vessel which has a high concentration of floating materials. The vessel does not contain a plunger or any other means for circulating the cleaning fluid. Furthermore, the vessel is used for cleaning the outside of the filter media rather than the inside.

There remains the need for a closed cleaning system which uses a cleaning rod inside the barrel of a gun to move the cleaning fluid in a continuous cycle through the barrel to clean the inside of the barrel.

OBJECTS

It is therefore an object of the present invention to provide a gun barrel cleaning apparatus which uses a closed container with cleaning fluid and a cleaning rod to continuously move the cleaning fluid through the barrel to clean the inside of the barrel. Further, it is an object of the present invention to provide a gun barrel cleaning apparatus which allows a single supply of cleaning fluid to be moved continuously through the barrel of a gun without the loss of fluid. Still further, it is an object of the present invention to provide a gun barrel cleaning apparatus which holds the barrel and enables a user to easily move a cleaning rod up and down inside the barrel of a gun. Further still, it is an object of the present invention to provide an apparatus and method for cleaning the barrel of a gun which allows the inside of a barrel of a gun to be easily and quickly cleaned.

These and other objects will become increasingly apparent by reference to the following drawings and the description.

DETAILED DESCRIPTION OF THE PREFERRED EMBODIMENT

Figure 1:
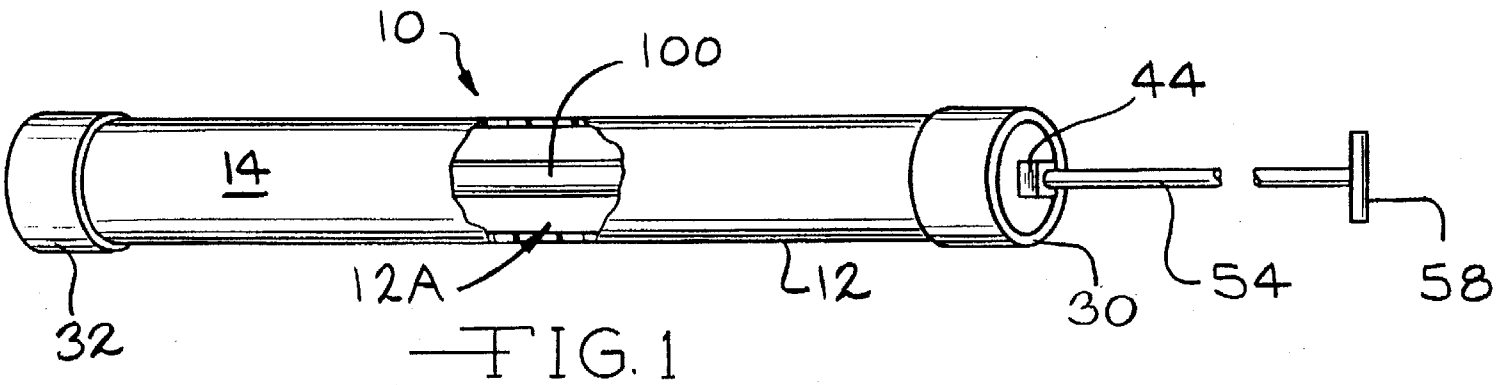
FIG. 1 is a front view of the gun cleaning apparatus 10 with a cutaway portion showing the barrel 100 mounted in the inner chamber 12A of the container 12.

The present invention relates to an apparatus for cleaning a barrel of a gun, which comprises: a tubular member having a first end and a second end with a sidewall extending therebetween forming a chamber in the tubular member along a longitudinal axis of the tubular member; first and second end caps configured to be mounted on the first and second ends of the tubular member for sealing the ends of the tubular member to form a closed container, each end cap having an inside surface with a holder having a sidewall and a recess extending parallel to the longitudinal axis of the tubular member for holding the barrel of the gun wherein at least one of the holders has orifices in the sidewall to allow fluid to flow from the barrel through the holder and wherein one of the end caps has an opening extending through the recess of the holder and parallel to a longitudinal axis of the tubular member; and a cleaning rod mounted through the opening in the end cap and configured to fit inside the barrel of the gun for cleaning an inside surface of the barrel of the gun, wherein to clean the barrel, the barrel is mounted in the holders inside the tubular member, the tubular member is partially filled with cleaning fluid and the cleaning rod is moved up and down the inside of the barrel of the gun to move the cleaning fluid into the inside of the barrel of the gun.

Further, the present invention relates to a method for cleaning a barrel of a gun, which comprises: providing a tubular member having a first end and a second end with a sidewall extending therebetween forming a chamber in the tubular member along a longitudinal axis of the tubular member; first and second end caps configured to be mounted on the first and second ends of the tubular member for sealing the ends of the tubular member to form a closed container, each end cap having an inside surface with a holder having a sidewall and a recess extending parallel to the longitudinal axis of the tubular member for holding the barrel of the gun wherein at least one of the holders has orifices in the sidewall to allow fluid to flow from the barrel through the holder and wherein one of the end caps has an opening extending through the recess of the holder and parallel to a longitudinal axis of the tubular member; and a cleaning rod mounted through the opening in the end cap and configured to fit inside the barrel of the gun for cleaning an inside surface of the barrel of the gun, wherein to clean the barrel, the barrel is mounted in the holders inside the tubular member, the tubular member is partially filled with cleaning fluid and the cleaning rod is moved up and down the inside of the barrel of the gun to move the cleaning fluid into the inside of the barrel of the gun; removing the first end cap from the tubular member; mounting a first end of the barrel of the gun in the recess of the holder of the second end cap mounted on the end of the tubular member; filling the chamber of the tubular member with cleaning fluid; securing the first end cap on the end of the tubular member so that a second end of the barrel of the gun is mounted in the recess of the holder of the first end cap; inserting the cleaning rod into the opening in one of the end caps of the tubular member inside the barrel; and moving the cleaning rod in an up and down movement so that the fluid is moved up the inside of the barrel and the cleaning rod with the fluid clean the inside of the barrel.

Figure 2:
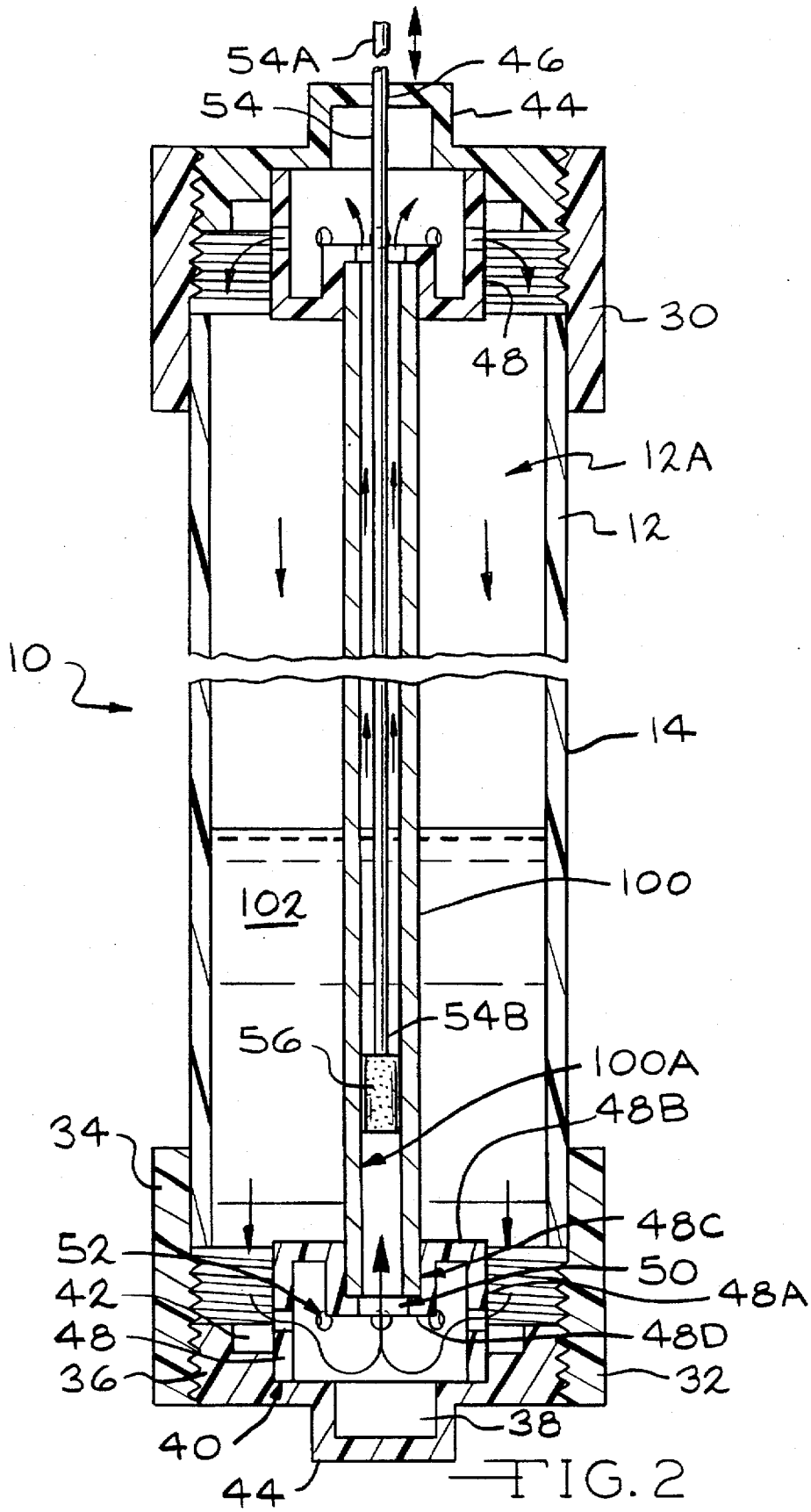
FIG. 2 is a cross-sectional view of the gun cleaning apparatus 10 showing the top and bottom end caps 30 and 32 and illustrating the flow of cleaning fluid 102 through the gun barrel 100 and around the inner chamber 12A of the container 12.

FIGS. 1 and 2 show the gun cleaning apparatus 10 of the present invention for cleaning the inside surface 100A of a barrel 100 of a gun. The apparatus 10 includes a container 12 having an open-ended hollow tubular member 14 forming a longitudinal axis A—A of the apparatus 10 with removable top and bottom end caps 30 and 32 and a cleaning rod 54. The tubular member 14 preferably has a cylindrical shape with a length essentially equal or alternately, slightly greater than the length of the barrel 100 to be cleaned. In the preferred embodiment, when the barrel 100 of a muzzle loader has a length of 29.5 inches (74.9 cm) is to be cleaned, the container 12 has a length of 33.0 inches (83.8 cm).

Figure 3:
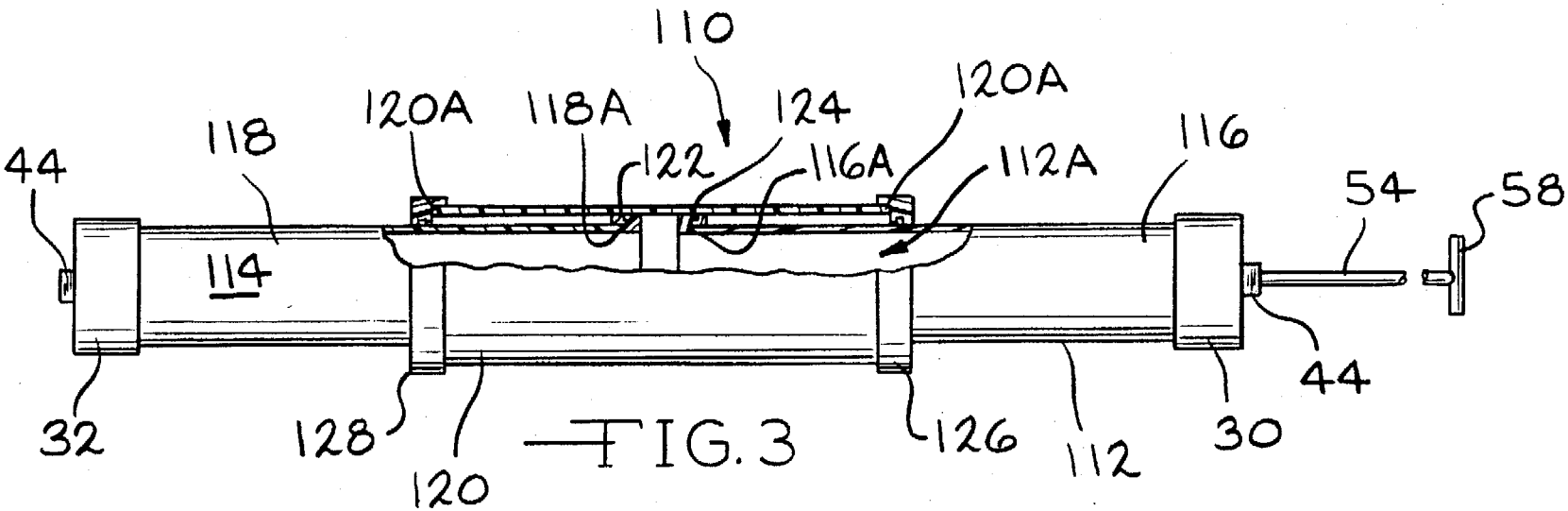
FIG. 3 is a front view of a first alternate embodiment of the gun cleaning apparatus 110 with a cut away section showing the adjustable upper and lower members 116 and 118 of the container 112.
Figure 4:
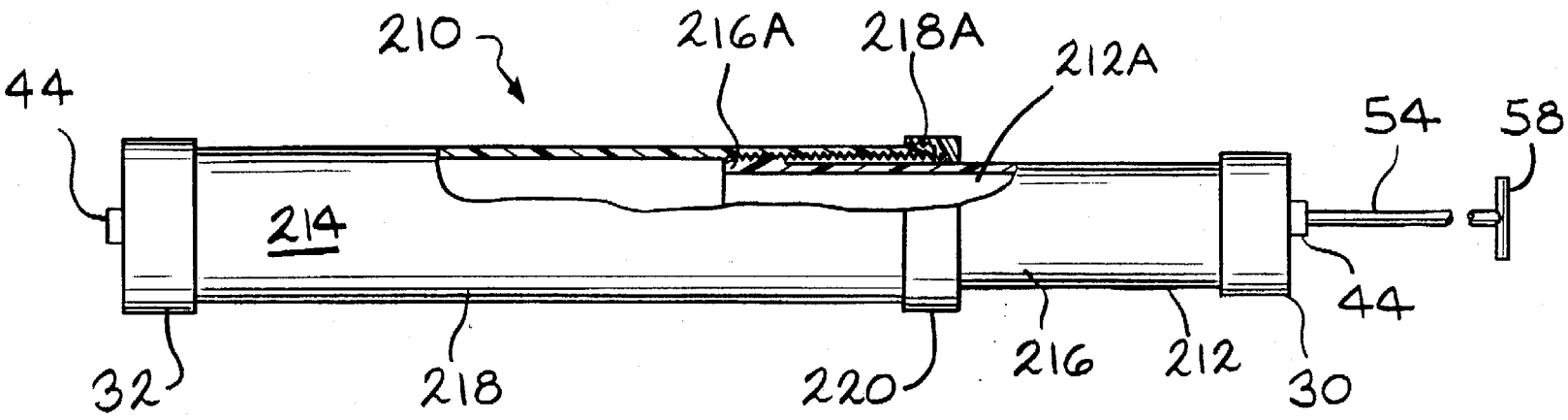
FIG. 4 is a front view of a second alternate embodiment of the gun cleaning apparatus 210 with a cut away section showing the adjustable inner and outer members 216 and 218 of the container 212.

In the first and second alternate embodiments of the invention as shown in FIGS. 3 and 4, the tubular member 114 or 214 of the container 112 or 212 is adjustable along the longitudinal axis A—A of the apparatus 110 or 210 to accommodate barrels 100 of different lengths. In the first embodiment, the tubular member 114 of the container 112 has upper and lower members 116 and 118 which are connected together by an adjustment sleeve 120 (FIG. 3). The upper and lower members 116 and 118 of the tubular member 114 can be moved along the length of the adjustment sleeve 120 to adjust the length of the member 114. The ends 116A and 118A of the upper and lower members 116 and 118 which are located within the sleeve 120, are provided with sealing rings 122 and 124 respectively, which prevent the cleaning fluid 102 inside the container 112 from entering into the sleeve 120. The ends 120A of the sleeve 120 are also provided with sealing caps 126 and 128 to secure the sleeve 120 on the upper and lower members 116 and 118 of the tubular member 114 and to prevent any cleaning fluid 102 which has escaped into the sleeve 120 from escaping the sleeve 120. In the second alternate embodiment, the tubular member 214 is comprised of inner and outer members 216 and 218. The bottom 216A of the inner member 216 has threads on the outer surface which threadably mate with threads on the inner surface of the top 218A of the outer member 218. The top end of the outer member 218 is provided with a sealing cap 220 which secures the inner and outer members 216 and 218 together and prevents the cleaning fluid 102 from escaping the tubular member 214. Preferably, the threads on the outer surface of the inner member 216 are provided with a Teflon® layer (not shown) such as Teflon® tape to provide a better seal between the threads of the inner and outer members 216 and 218.

In all the embodiments, the outside surface of the ends of the tubular member 14, 114 or 214 are preferably threaded to allow the top and bottom end caps 30 and 32 to be threadably mated onto the ends of the member 14, 114 or 214. In the preferred embodiment, when the end caps 30 and 32 are securely threaded onto the ends of the member 14, 114 or 214, the end caps 30 and 32 and the tubular member 14, 114 or 214 form a sealed container 12,112, or 212 having an inner chamber 12A, 112A or 212A. The threads on the outer surface of the tubular member 14, 114 or 214 can be provided with Teflon® to provide better sealing between the threads on the tubular member 14, 114 or 214 and the threads on the end caps 30 and 32 to prevent the cleaning fluid 102 from escaping from the inner chamber 12A, 112A or 212A of the container 12, 112 or 212. The top and bottom end caps 30 and 32 are preferably similar in construction. The end caps 30 and 32 are preferably constructed of an outer cylindrical sleeve 34 and an end portion 36. The end portion 36 is preferably threadably mated into one end of the sleeve 34 to close one end of the sleeve 34 and the end cap 30 or 32. The end portion 36 preferably extends into the sleeve 34 such that the outer surface of the end portion 36 is flush with the end of the sleeve 34. The end caps 30 and 32 mount on the ends of the member 14, 114 or 214 so that the ends of the tubular member 14, 114 or 214 extend into the end caps 30 and 32 and the end portions 36 of the end caps 30 and 32 form the closed ends of the container 12, 112 or 212. The inside surface of the end portion 36 preferably has a series of stepped recesses 38, 40 and 42 extending concentrically around the end portion 36 (FIG. 2). In the preferred embodiment, there are three concentric recesses 38, 40 and 42 in the end portion 36. The inner most recess 38 has a depth such that the outer surface of the end portion 36 extends outward forming the bottom of the recess 38 to form a protrusion 44 on the outer surface of the end portion 36 (FIG. 2). The protrusion 44 preferably has a square shape and enables a user to easily remove the end caps 30 and 32 using a standard wrench or their hands. The protrusion 44 in the top end cap 30 preferably has an opening 46 which is concentric with the longitudinal axis A—A of the tubular member 14, 114 or 214 (FIG. 2). The opening 46 preferably has a diameter equal to the inner diameter of the barrel 100.

The inner surface of the end caps 30 and 32 are provided with holders 48 for holding the ends of the barrel 100 to be cleaned. The holders 48 are preferably located in the middle recesses 40 of the end portions 36 of the end caps 30 and 32 directly over the protrusion 44 on the opposite side of the end portion 36. The holders 48 preferably have a hollow, cylindrical shape with a circular sidewall 48A and a top wall 48B. The holders 48 preferably extend upward from the middle recess 40 of each end cap 30 and 32 and inward toward the inner chamber 12A, 112A or 212A of the container 12, 112 or 212 such that the top wall 48B is flush with the adjacent end of the tubular member 14, 114 or 214. The top wall 48B of the holders 48 has a recess 48C located in the center which is concentric with the longitudinal axis A—A of the tubular member 14, 114 or 214. The recess 48C preferably has a bottom wall 48D with an opening 50. The diameter of the recess 48C is preferably slightly greater than the diameter of the end of the barrel 100 to be mounted in the recess 48C. Therefore, the diameter of the recess 48C can be varied to accommodate barrels having different diameters. The sidewall 48A of the holders 48 is preferably provided with orifices 52. There are preferably several orifices 52 located around the circumference of the sidewall 48A. In the preferred embodiment, the orifices 52 are located in the sidewall 48A essentially level with the bottom wall 48D of the recess 48C.

In an alternate embodiment (not shown), the barrel to be cleaned has an opening in the sidewall spaced above the breech end. In this embodiment, the bottom end cap 32 does not have the opening 56 in the bottom wall 48D of the recess 48C or have the orifices 52 in the sidewall 48A of the holder 48. The tubular member 14, 114 or 214 and the end caps 30 and 32 are preferably constructed of a lightweight, durable material such as PVC; although, other well known materials can also be used. Preferably, the material which is used for the sidewall of the recess 48C of the holder 48 in the end cap 30 or 32 is smooth such as to not damage the barrel 100 of the gun. In the preferred embodiment, the diameter of the tubular member 14, 114 or 214 is 11.0 inches (27.9cm). However, the diameter will be determined by the diameter of the barrel 100 of the gun to be cleaned and the amount of cleaning fluid 102 needed to clean the barrel 100.

The cleaning rod 54 has opposed ends 54A and 54B and is mounted in the opening 46 in the protrusion 44 of the top end cap 30 such that the first end 54A of the cleaning rod 54 extends into the inner chamber 12A, 112A or 212A of the container 12, 112 or 212 and the second end 54B extends outward, above the container 12, 112 or 212. The first end 54A of the cleaning rod 54 preferably can be alternately provided with a brush 56 or a cleaning patch (not shown) to assist in cleaning of the inside of the barrel 100. The diameter of the brush 56 is preferably equal to the diameter of the inside of the barrel 100. Alternately, two cleaning rods (one shown) are used each having a different cleaning implement on the first end. The second end 54B of the cleaning rod 54 which extends out of the container 12, 112 or 212 preferably has a handle 58 to allow the user to easily grip the cleaning rod 54. The cleaning rod 54 has a length at least greater than the length of the barrel 100 plus the length of the end portion 36 and protrusion 44 of the end cap 30 so that when the first end 54A of the cleaning rod 54 is at the far end of the barrel 100, the cleaning rod 54 extends through the barrel 100, through the opening 50 in the recess 48C of holder 48 and through the opening 46 in the protrusion 44 of the end cap 30 such that the handle 58 can be easily grasped to move the cleaning rod 54 up and down in the barrel 100.

IN USE

In all embodiments, to use the apparatus 10, 110 or 210 to clean the barrel 100 of the gun, the bottom end cap 32 is first mounted on one end of the tubular member 14, 114 or 214. Preferably, the ends of the tubular member 14, 114 or 214 are identical. The container 12, 112 or 212 is then held in the vertical position and the barrel 100 of the gun is inserted into the inner chamber 12A, 112A or 212A of the tubular member 14, 114 or 214. The barrel 100 is inserted into the chamber 12A, 112A or 212A until the end of the barrel 100 is mounted in the recess 48C in the holder 48 in the bottom end cap 32. In the first and second alternate embodiments, the length of the tubular member 114 or 214 is fixed, according to the length of the barrel 100 prior to mounting the barrel 100 in the container 112 or 212 (FIGS. 3 and 4). Once the barrel 100 is mounted in the container 12, 112 or 212, the cleaning fluid 102 is then poured into inner chamber 12A, 112A or 212A of the container 12, 112 or 212. In the preferred embodiment, the cleaning fluid 102 is hot water mixed with soap such as liquid dish soap. Preferably, the container 12, 112 or 212 is filled about ¼ full with the cleaning fluid 102. In the preferred embodiment about 0.5–1.0 gallons of soap and water are poured into the inner chamber 12A, 112A or 212A of the container 12, 112 or 212. The top end cap 30 is then secured on the open top of the tubular member 14, 114 or 214 so that the top end of the barrel 100 is mounted in the recess 48C in the holder 48 in the top end cap 30. Preferably, the holder 48 in the bottom end cap 32 holds the barrel 100 aligned with the longitudinal axis A—A of the apparatus 10, 110 or 210 such that the top of the barrel 100 is easily inserted into the recess 48C of the holder 48 in the top end cap 30. The top end cap 30 is then secured on the top end of the tubular member 14, 114 or 214 such that a sealed container 12, 112 or 212 is formed. Next, the first end 54A of the cleaning rod 54 is inserted into the opening 46 in the protrusion 44 of the top end cap 30 and down into the barrel 100. The position of the opening 50 and the holder 48 preferably align the barrel 100 and the cleaning rod 54 so that the cleaning rod 54 is easily inserted into the inside of the barrel 100. In the preferred embodiment, the first end 54A of the cleaning rod 54 is initially provided with the brush 56. As the cleaning rod 54 is moved downward inside the barrel 100, any cleaning fluid 102 in the inside of the barrel 100 is pushed down the barrel 100 and out the bottom of the barrel 100. The fluid 102 ejected from the bottom of the barrel 100 exits through the opening 50 in the bottom wall 48D of the recess 48C in the holder 48 in the bottom end cap 32 and out the orifices 52 in the sidewall 48A of the holder 48 and into the inner chamber 12A, 112A or 212A of the container 12, 112 or 212. Once the cleaning rod 54 is completely inserted into the barrel 100, the cleaning rod 54 is moved upward, inside of the barrel 100. As the cleaning rod 54 is moved upward, the cleaning fluid 102 is drawn through the orifices 52 in the sidewall 48A of the holder 48 and the opening 50 in the end wall of the recess 48C of the holder 48 and into the inside of the barrel 100. As the cleaning rod 54 is continued to be moved up the barrel 100, the cleaning fluid 102 is continued to be pulled up the inside of the barrel 100. The cleaning rod 54 is moved upward until the cleaning rod 54 is completely out of the top of the barrel 100 and the first end 54A of the cleaning rod 54 is positioned in the holder 48 or protrusion 44 of the top end cap 30. When the cleaning rod 54 is completely removed from the barrel 100, the cleaning fluid 102, which was pulled through the inside of the barrel 100, ejects from the upper end of the barrel 100 through the opening 50 in the end wall of the recess 48C and through the orifices 52 in the sidewall 48A of the holder 48 and back into the inner chamber 12A, 112A or 212A of the container 12, 112 or 212. Alternately, the cleaning rod 54 is not completely removed from the barrel 100 during each up and down motion. The orifices 52 in the holder 48 in the bottom end cap 32 allow the cleaning fluid 102 to be moved into and out of the barrel 100 to clean the barrel 100 during each up and down movement. In the preferred embodiment, the cleaning rod 54 with the brush 56 is moved rapidly, completely up and down the barrel 100 for about 1.0 to 2.0 minutes. As the cleaning rod 54 is moved up and down, the brush 56 on the end of the cleaning rod 54 cleans the inside of the barrel 100. In addition, the cleaning fluid 102 is moved through the inside of the barrel 100 in a continuous manner which also cleans the inside of the barrel 100. The cleaning rod 54 is then completely removed from the container 12, 112 or 212 and the brush 56 is replaced with the cleaning patch. The cleaning rod 54 is then reinserted into the container 12, 112 or 212 and the barrel 100. The above procedure is then repeated using the cleaning patch. In the alternate embodiment where the barrel 100 has an opening in the sidewall, as the cleaning rod 54 is moved up the inside of the barrel 100, the cleaning fluid 102 is drawn into the inside of the barrel 100 through the side opening.

Once the barrel 100 is clean, the cleaning rod 54 and the upper end cap 30 are removed from the container 12, 112 or 212. Next, the barrel 100 is removed from the container 12, 112 or 212 and the used cleaning fluid 102 is dumped out of the chamber 12A, 112A or 212A. Alternately, the cleaning fluid 102 is dumped first, prior to removing the barrel 100. Preferably, the entire cleaning process takes only 11.0 minutes. If necessary, the inner chamber 12A, 112A or 212A of the container 12, 112 or 212 can be cleaned prior to the next use. The apparatus 10, 110 or 210 is preferably used to clean the inside of a barrel 100 of a black powder gun.

It is intended that the foregoing description be only illustrative of the present invention and that the present invention be limited only by the hereinafter appended claims.

I claim:

1. An apparatus for cleaning a barrel of a gun, which comprises:

(a) a tubular member having a first end and a second end with a sidewall extending therebetween forming a chamber in the tubular member along a longitudinal axis of the tubular member;

(b) first and second end caps configured to be mounted on the first and second ends of the tubular member for sealing the ends of the tubular member to form a closed container, each end cap having an inside surface with a holder having a sidewall and a recess extending parallel to the longitudinal axis of the tubular member for holding the barrel of the gun wherein at least one of the holders has orifices in the sidewall to allow fluid to flow from the barrel through the holder and wherein one of the end caps has an opening extending through the recess of the holder and parallel to a longitudinal axis of the tubular member; and (c) a cleaning rod mounted through the opening in the end cap and configured to fit inside the barrel of the gun for cleaning an inside surface of the barrel of the gun, wherein to clean the barrel, the barrel is mounted in the holders inside the tubular member, the tubular member is partially filled with cleaning fluid and the cleaning rod is moved up and down the inside of the barrel of the gun to move the cleaning fluid into the inside of the barrel of the gun.

2. The apparatus of claim 1 wherein the sidewall of the tubular member is adjustable along the longitudinal axis of the tubular member to allow for cleaning barrels having different lengths.

3. The apparatus of claim 1 wherein the tubular member has a cylindrical shape.

4. The apparatus of claim 1 wherein both end caps are removably mounted.

5. The apparatus of claim 1 wherein the sidewall of the holder extends inward away from the inside surface of the end cap and wherein the holder has an end wall spaced apart from the inside surface of the end cap and having the recess.

6. The apparatus of claim 5 wherein the recess of the holder has a sidewall and an end wall wherein the end wall is spaced apart from the inside surface of the end cap and has an opening extending parallel to the longitudinal axis of the tubular member.

7. The apparatus of claim 6 wherein the sidewall of the recess is spaced apart and parallel to the sidewall of the holder.

8. The apparatus of claim 7 wherein the sidewall of the holder is provided with orifices.

9. The apparatus of claim 8 wherein the sidewall of the recess is of such a length that the end wall of the recess does not extend below the orifices.

10. The apparatus of claim 1 wherein the recess of the holders of the end caps have a cylindrical shape.

11. The apparatus of claim 1 wherein the cleaning rod has a brush at one end.

12. A method for cleaning a barrel of a gun, which comprises:

(a) providing a tubular member having a first end and a second end with a sidewall extending therebetween forming a chamber in the tubular member along a longitudinal axis of the tubular member; first and second end caps configured to be mounted on the first and second ends of the tubular member for sealing the ends of the tubular member to form a closed container, each end cap having an inside surface with a holder having a sidewall and a recess extending parallel to the longitudinal axis of the tubular member for holding the barrel of the gun wherein at least one of the holders has orifices in the sidewall to allow fluid to flow from the barrel through the holder and wherein one of the end caps has an opening extending through the recess of the holder and parallel to a longitudinal axis of the tubular member; and a cleaning rod mounted through the opening in the end cap and configured to fit inside the barrel of the gun for cleaning an inside surface of the barrel of the gun, wherein to clean the barrel, the barrel is mounted in the holders inside the tubular member, the tubular member is partially filled with cleaning fluid and the cleaning rod is moved up and down the inside of the barrel of the gun to move the cleaning fluid into the inside of the barrel of the gun;

(b) removing the first end cap from the tubular member;

(c) mounting a first end of the barrel of the gun in the recess of the holder of the second end cap mounted on the end of the tubular member;

(d) filling the chamber of the tubular member with cleaning fluid;

(e) securing the first end cap on the end of the tubular member so that a second end of the barrel of the gun is mounted in the recess of the holder of the first end cap;

(f) inserting the cleaning rod into the opening in one of the end caps of the tubular member inside the barrel; and (g) moving the cleaning rod in an up and down movement so that the fluid is moved up the inside of the barrel and the cleaning rod with the fluid clean the inside of the barrel.

13. The method of claim 12 wherein the cleaning fluid contains warm water and detergent.

14. The method of claim 12 wherein the tubular member is filled approximately about ¼ full of the cleaning fluid.

15. The method of claim 12 wherein the cleaning rod is moved from the one end of the barrel completely up through and out of the other end of the barrel so that the cleaning fluid enters one end of the barrel and flows upward through the barrel and out the other end of the barrel and out the orifices in the holder and back into the chamber of the tubular member.

16. The method of claim 12 wherein the cleaning rod has a brush at one end so that as the cleaning rod is moved up and down inside the barrel, the brush comes in contact with the inside surface of the barrel and cleans the barrel.

17. The method of claim 12 wherein the cleaning rod is moved up and down inside the barrel for about 2 to 5 minutes to clean the barrel.

18. The method of claim 12 wherein after the barrel is clean, the cleaning rod is removed from the tubular member, the end cap is removed from the tubular member, the barrel is removed from the tubular member and the cleaning fluid is then emptied from the tubular member.

19. The method of claim 12 wherein the barrel is a barrel for a muzzle loading rifle.

20. The method of claim 12 wherein the tubular member is adjustable along the longitudinal axis of the tubular member and wherein a length of the tubular member is adjusted prior to mounting the gun in the barrel.

* * * * *